United States Patent [19]

Sato

[11] 4,144,809

[45] Mar. 20, 1979

[54] CODE PLATE DEVICE FOR A LABELING MACHINE

[75] Inventor: Yo Sato, Tokyo, Japan

[73] Assignee: Kabushiki Kaisha Sato, Japan

[21] Appl. No.: 777,539

[22] Filed: Mar. 14, 1977

[30] Foreign Application Priority Data

Mar. 15, 1976 [JP] Japan ..... 51/27203

[51] Int. Cl.[2] ..... B41F 1/08

[52] U.S. Cl. ..... 101/288; 101/384

[58] Field of Search ..... 101/287, 288, 291, 292, 101/297, 316, 368, 382 R, 383, 384, 269

[56] References Cited

U.S. PATENT DOCUMENTS

| | | | |
|---|---|---|---|
| 2,792,778 | 5/1957 | Schlegel et al. | 101/287 X |
| 3,376,811 | 4/1968 | Grintz | 101/288 X |
| 3,673,960 | 7/1972 | Ricci et al. | 101/269 |
| 3,908,544 | 9/1975 | Seidl et al. | 101/292 |
| 4,018,154 | 4/1977 | Matsumoto et al. | 101/287 X |
| 4,041,863 | 8/1977 | Mullen et al. | 101/288 |

*Primary Examiner*—Edward M. Coven

*Attorney, Agent, or Firm*—Ostrolenk, Faber, Gerb & Soffen

[57] ABSTRACT

A code imprinting plate device for use along with the print heads of a portable labeling machine: the code plate device includes a casing that is removably retained in position on the frame of the printing device of the labeling machine, an imprinting code plate having type characters on it and adapted to be inserted into and removed from the casing, a sliding assembly which is slidable in the casing in response to the insertion and removal of the code plate; engagement and disengagement means are brought into and out of engagement with the sliding assembly so as to hold that assembly in position; the code plate is retained in position in the casing, whereby the label can be imprinted with the type characters on the code plate in addition to those on the other heads of the printing device.

12 Claims, 5 Drawing Figures

CODE PLATE DEVICE FOR A LABELING MACHINE

BACKGROUND OF THE INVENTION

1. Field of the Invention

The present invention relates to a code plate device for use with a labeling machine, particularly a portable one.

2. Description of the Prior Art

A printing device for a labeling machine and particularly a portable one is often equipped with several endless type character bands for printing information, such as price or production date of a commodity. Each of the bands has its exterior printing surface covered with a number of type characters, such as the numerals from 0 to 9 or the letters of the alphabet, and the characters are equally spaced apart. The character bands are rotatable with respect to one another so that the type characters on adjacent bands may be combined to imprint a label with the letters indicating the price or production date, for example. There is a recent trend for labels to be imprinted with more information than the price or date. This additional information may include the name of a commodity, its size, production date, final sale date, quality, color, indication such as "Discount Price" or "Bargain Sale", etc.

To apply the above specified indications, labels are now imprinted by large size labeling machines in a mass production manner. In small scale label production, however, the labels are stamped one by one by a rubber stamp. It has been proposed to attach a code plate carrying specified additional letters, marks and/or characters to the printing device. However, the attachment and removal of the code plate cannot be accomplished easily and promptly. Thus, the desired addition of information to smaller scale labeling machines cannot be attained.

SUMMARY OF THE INVENTION

It is the primary object of the present invention to provide a labeling machine with a code plate device that is free from the drawbacks of the prior art.

Another object of the present invention is to provide such a code plate device, which can be removably attached in position to the frame of a printing device in a labeling machine.

A further object of the present invention is to provide such a code plate device, in which the code plate carrying the additional information and characters can be easily inserted into and removed, and in which the entire device can be removably retained in the frame of the printing device.

Yet another object of the present invention is to provide such a code plate device which can be easily replaced and which can easily be shifted to a different position in the frame of the printing device.

According to the present invention, a code plate device for use with a portable labeling machine comprises a casing, first retaining means for removably retaining the casing in position in the frame of a printing device of the labeling machine, a code plate having type characters on its printing surface, the code plate being adapted to be inserted into and removed from the casing, a sliding assembly which is slidable in the casing in response to the insertion and removal of the code plate, engagement means guided in response to the sliding movement of the sliding assembly for being brought into and out of engagement with the sliding assembly so as to hold the same in position, and second retaining means for retaining the inserted code plate in position in the casing.

DESCRIPTION OF A PREFERRED EMBODIMENT

Figure 1:
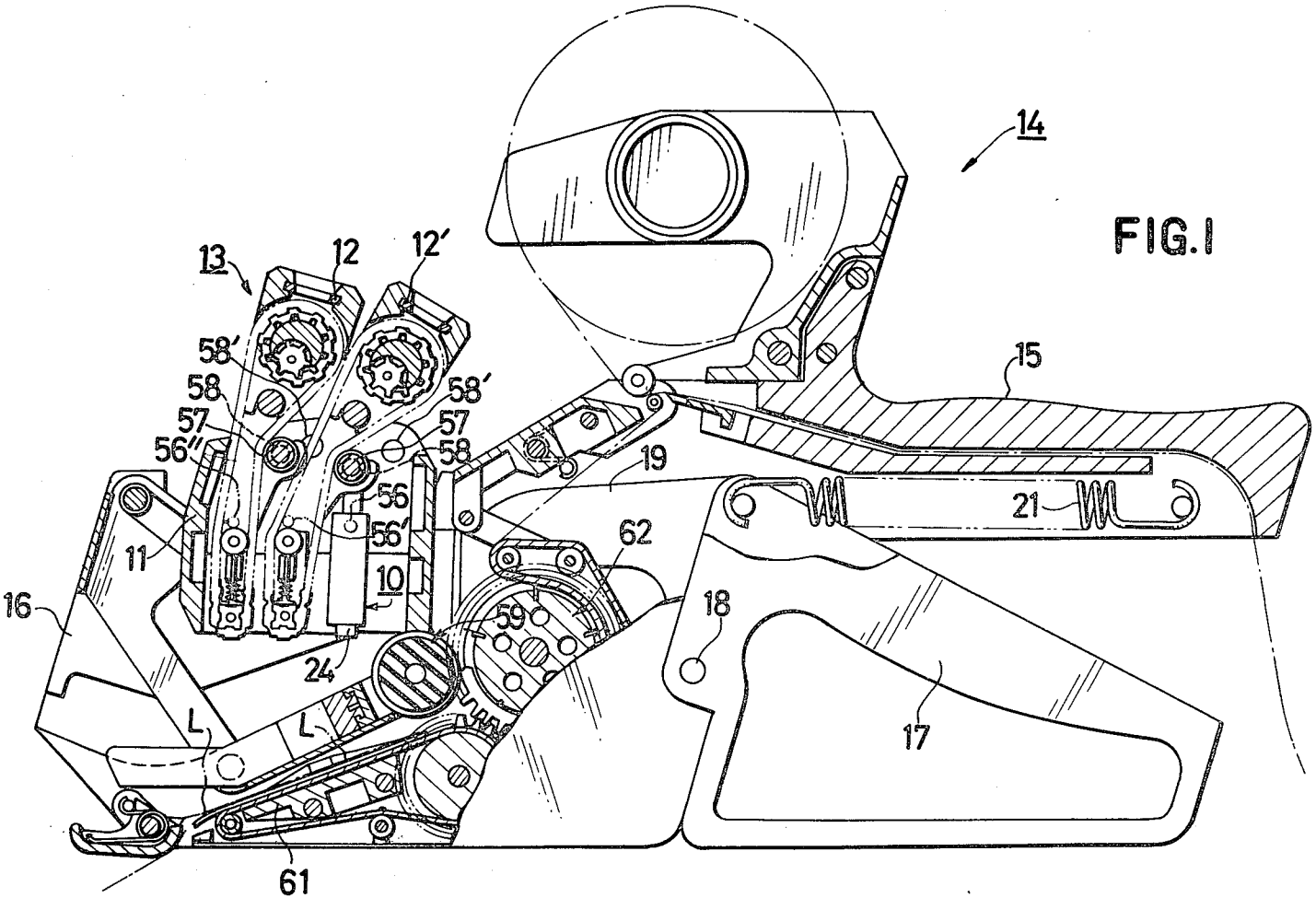
FIG. 1 is a partially cross-sectional, side elevational view showing a portable labeling machine equipped with a code plate device of the present invention.

In the portable labeling machine 14 of FIG. 1, the code plate device 10 according to the present invention is removably mounted between the frames 11 that support two printing heads 12 and 12' of the printing device. The printing heads 12 and 12' carry standard information about a commodity, such as its price or production cost.

The labeling machine 14 has a grip 15 which is integral with the side support frames 16 of the labeling machine 14. A hand lever 17 is pivotally connected between the machine frames 16 on a pivot 18. The leading (left-hand) end of the lever 17 is bifurcated to define yokes 19.

The printing device 13 carrying the printing heads 12 and 12' is attached to the leading ends of the yokes 19 so that the printing heads move together with the yoke. A tensioned spring 21 is connected between the hand lever 17 and the grip 15 so that the hand lever 17, the yokes 19 and the printing device 13 are at all times biased clockwise about the pivot 18 in FIG. 1.

Figure 2:
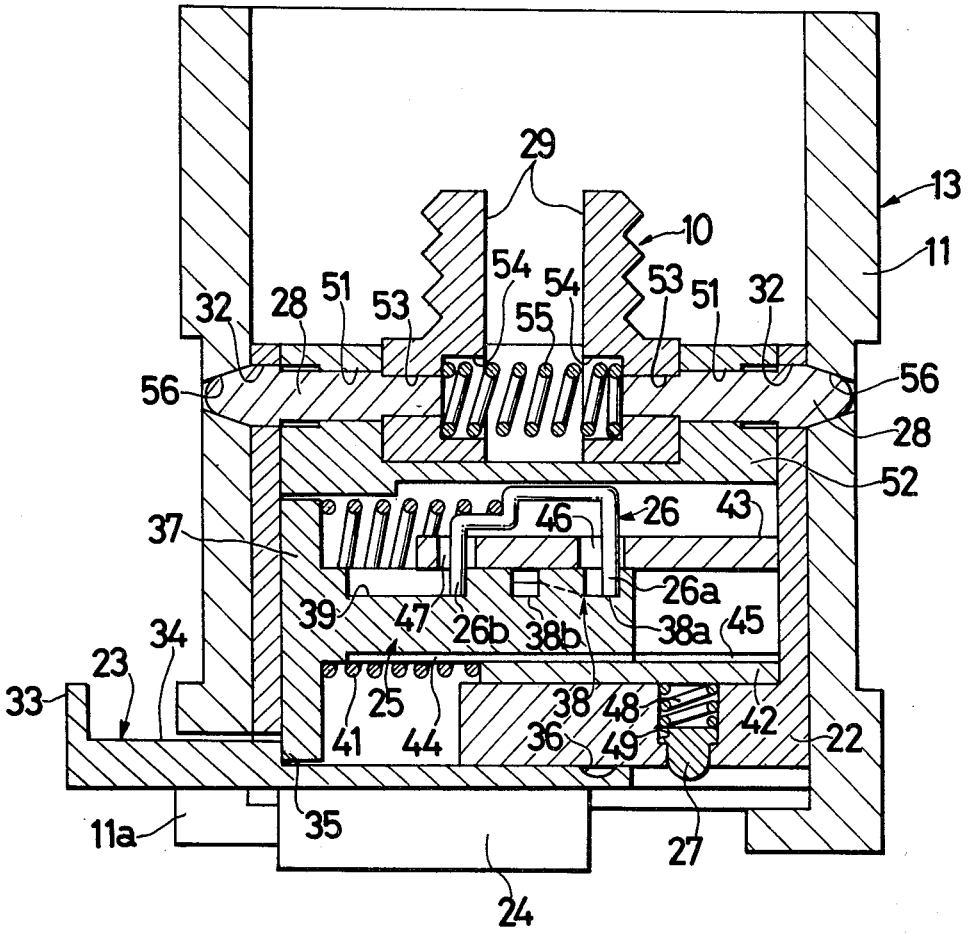
FIGS. 2 and 3 are cross-sectional, end elevational views of the code plate device, with the code plate shown in the released and the retained conditions, respectively.
Figure 3:
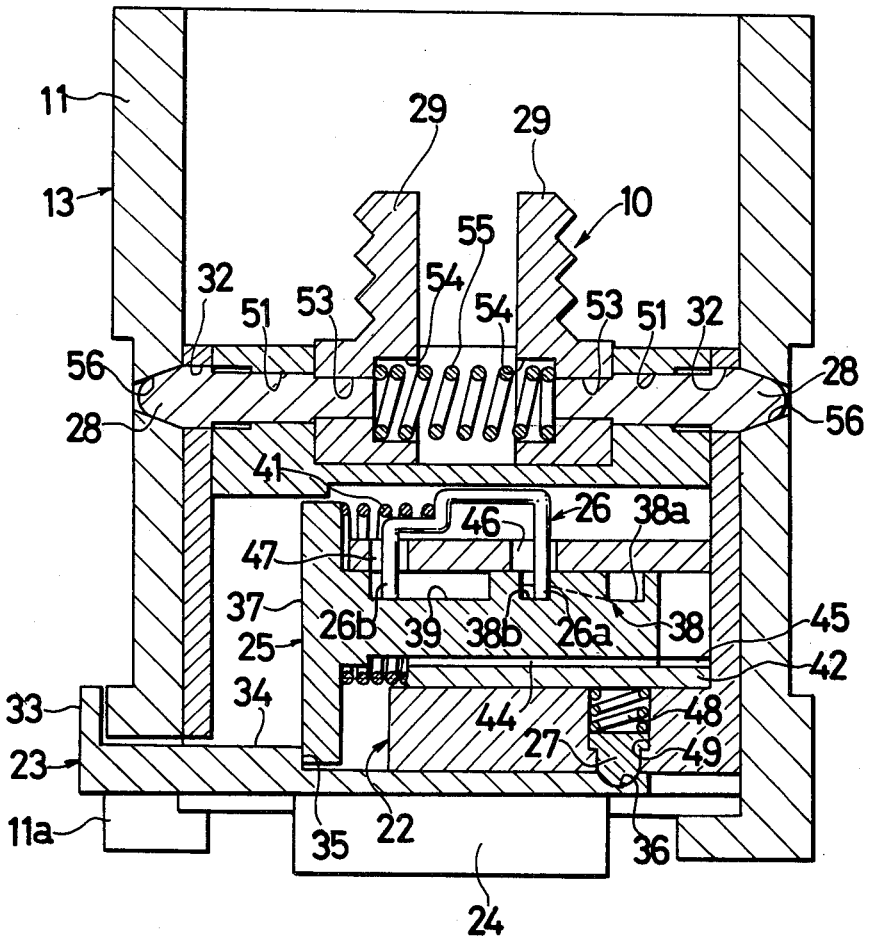
Figure 4:
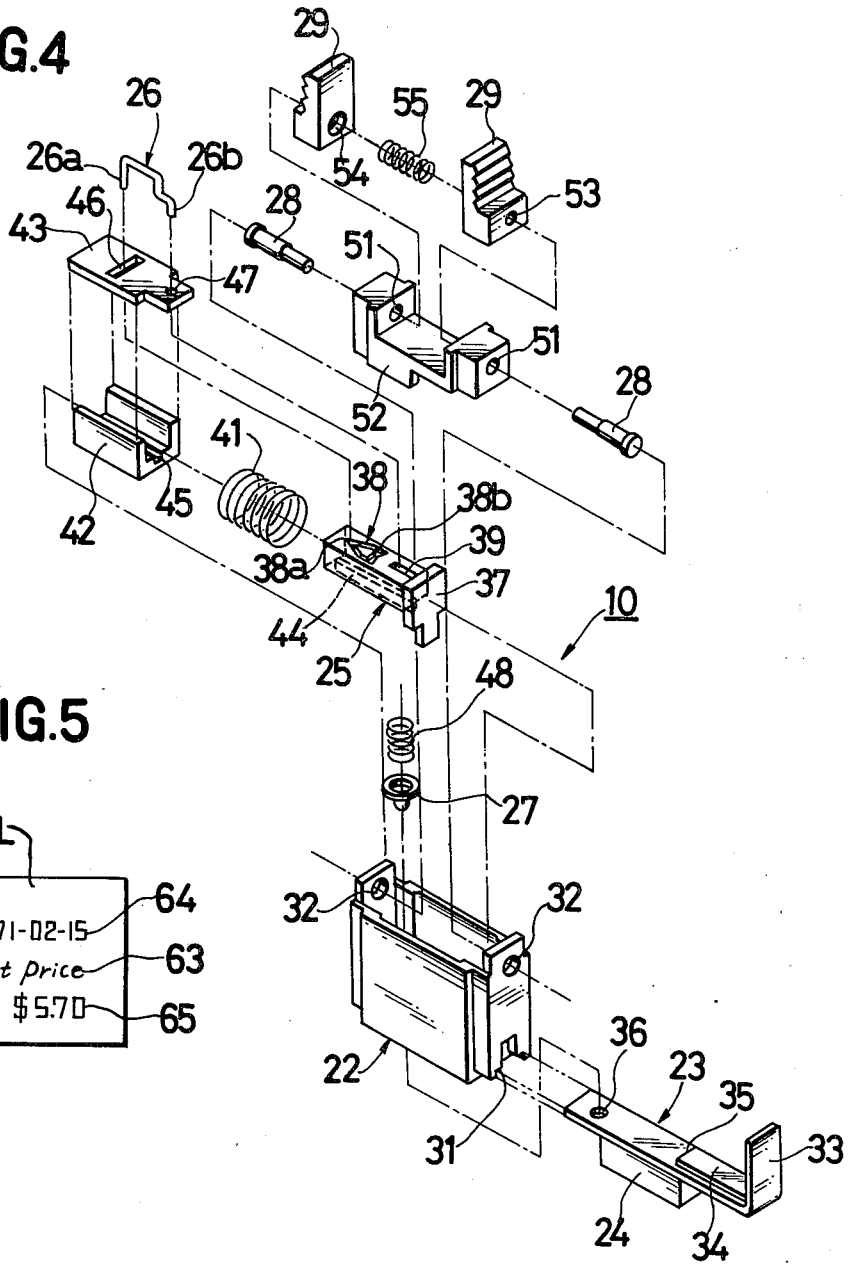
FIG. 4 is an exploded perspective view of the code plate device.

Turning to FIGS. 2 to 4, the code plate device 10 includes a casing 22 and a code plate 23 which has a character member 24 which carries specified letters, marks and/or characters.

There is a sliding assembly 25 which is slidable in response to the inward and outward movement of the code plate 23 so that the code plate may be elastically retained in the casing. There is also a stationary engagement member 26 which is guided into and engages the sliding assembly 25.

A retaining button 27 retains the code plate 23 at a predetermined position. A pair of retaining rods 28 are retained in both frames 11 of the printing device 13. A pair of pinch members 29 are manually actuatable to move the retaining rods 28 into and out of engagement with the printing device 13.

The casing 22 has rectangularly shaped sides. A portion of its bottom is open. A longitudinally extending, somewhat flat guide groove 31 is formed in the bottom of the casing 22 in which the code plate 23 slides. Both of the shorter height and narrower width sides of the casing 22 have upwardly extending projections which have guide holes 32 in them for guiding the paired retaining rod 28 to the outside of the casing 22.

The bottom of the code plate 23 has the character member 24 adhered to it. The character member 24 is made of rubber and is formed on its underside with specified letters, marks and/or characters, e.g. the indications of "Discount Price" or "Christmas Sale", or the name, year, size, material, color or sale season of the commodity. The code plate 23 is L-shaped, with an upwardly extending arm that constitutes a thumb operated member 33. The horizontal arm of the code plate 23 has a step portion 34 on its upper surface. The leading or innermost end of the step portion is formed into a thrust surface 35 for thrusting the sliding assembly 25. The horizontal arm of the code plate 23 has a retaining recess 36 at its leading or free end in which the retaining button 27 is received.

The sliding assembly 25 has a flange 37 attached at its end facing toward thrust surface 35 and against which the thrust surface 35 may abut. The upper surface of the sliding assembly 25 has a heart-shaped cam groove 38 defined in it near its end away from flange 37. This groove surrounds and is defined by a central island. This sliding assembly upper surface also has a longitudinal guide groove 39 near flange 37. These grooves receive the bent wire form engagement member 26. The member 26 is a generally C-shaped wire, which is formed with a stepped portion at one side. The ends of member 26 are directed downward to act as guide portions **26*a* and 26*b***.

The guide portion **26*a* of the member 26 is fitted in and guided by the heart-shaped cam groove 38 along a circulating pathway around groove 38. The cam groove 38 is inclined upward in the advance direction of portion 26*a* in the direction toward the groove 39. At the end of the heart-shaped groove 38 nearest groove 39, a stepped recess 38*b* is formed. The cam groove 38 is also inclined upward in the return direction of motion of the guided portion 26*a*, namely, toward the rear recesses of the heart-shaped cam groove, where a retaining recess 38*a* is formed. Moreover, this retaining recess 38*a* is made to merge into the upwardly inclined lower groove wall leading toward the first mentioned end 38*b*** of the heart-shaped cam.

The longitudinal guide groove 39, in which the other guided portion **26*b* of the member 26** is fitted in a guided manner, has a flat bottom with a predetermined depth.

A coil spring 41 is mounted around and over a part of the sliding assembly 25 and it is enclosed by a casing 42 and a cover 43. The bottom surface of the sliding assembly 25 carries longitudinal guide projection 44. This projection is received in a guide groove 45 that extends logitudinally along the inner bottom of the casing 42. This casing has an upwardly facing C-shaped cross-section.

The cover 43 has through holes 46 and 47 which are placed and shaped so that the guided portions **26*a* and 26*b* of the member 26 may extend through the cover. The width of the transverse hole 46 is equal to or slightly larger than the maximum width of the heart-shaped cam groove 38 to permit the motion of portion 26*b* through the whole groove 38**.

The spring 41 is compressed with one end abutting against the inner periphery of the flange 37 of the sliding assembly 25 and the other end abutting against the end face of the casing 42 and the stepped portion of the engagement member 26. Thus, the sliding assembly 25 is biased at all times in the disengaging direction to the left in FIGS. 2 and 3.

The retaining button 27 with a spring 48 above it are both fitted together in a stepped bore 49 which is formed in the bottom of the casing 22. The upper end of the spring 48 abuts the bottom wall of the casing 42 of the sliding assembly 25. The button 27 is brought into removable retained engagement with the retaining recess 36 of the code plate 23 by the longitudinal sliding of the code plate 23. The button 27 also imparts the force of the spring 48 to the upper surface of the code plate 23.

The shafts of the paired retaining rods 28 are fitted to slide both into the guide holes 32 of the casing 22 and then into the stepped bores 51 of a retaining holder 52. The innermost portions of the shafts of the retaining rods 28 are fixedly fitted in the narrowed bores 53 which are formed at the bases of the paired pinch members 29. The paired pinch members 29 face each other and are placed between the both sleeve portions of the retaining holder 36. The bores 53 of the pinch members 29 have widened stepped portions 54. A spring 55 is placed in and extends between the stepped portions 54 to bias the outer ends of the retaining rods 28 longitudinally and into engagement with the opposed retaining bores 56 in the frames 11 of the printing heads 12 and 12'.

Referring to FIG. 1, there are also two pairs of retaining bores 56' and 56'' in addition to the bores 56. The bores 56 are located at the rearmost position of the printing head frames 11. The bores 56' and 56'' are located at the foremost and intermediate positions, respectively, at which the two printing heads 12 and 12' are arranged. As a result, a code plate device 10 may be retained in any of the pairs of bores 56, 56' and 56''.

When it is intended to shift the code plate device 10 to a desired position, the support shafts 57 of the printing heads 12 and 12', which are fixedly screwed into the printing head frames 11, are transferred from the fitting bores 58 in the frames 11 to other fitting bores 58'. In an alternative arrangement, one of the support shafts 57 is transferred to the corresponding one of the bores 58'.

Referring to FIGS. 2 and 3, the operation of the code plate device is now described. Generally, the code plate device is shifted from the condition of FIG. 2 to the condition of FIG. 3 when the code plate 23 having the character member 24 is inserted into the guide groove 31 of the casing 22.

The thrust surface 35 of the step portion 34 of the code plate 23 is then moved to the right in FIGS. 2 and 3 to abut the flange 37 of the sliding assembly 25. This thrusts the sliding assembly 25, the assembly casing 42, the casing cover 43 and the engagement member 26 longitudinally to the right in FIG. 2 through the casing 22 and against the bias of the spring 41. This thrusting action moves the guided portion **26*a* of the wire member 26 in the heart-shaped cam groove 38 of the sliding assembly 25 while the other guided portion 26*b* is guided to move in the longitudinal guide groove 39**.

In the initial condition of FIG. 2, the guided portion **26*a* of the member 26 is positioned in the right hand stepped recess 38*a*, which is formed in the narrow width end of the heart-shaped cam groove 38. The other guided portion 26*b* of member 26 is positioned in the rear end (right in FIG. 2) of the guide groove 39. Starting at this initial condition, the guide portion 26*a* is guided along the upwardly inclined groove portion of the cam groove 38 and it moves into a retaining recess 38*b*, in which it is retained. The other guided portion 26*b* is guided to the front (or the left end in FIG. 3) of the longitudinal guide groove 39** until it is stopped.

In synchronism with the foregoing, the retaining button 27, which is pushing against the upper surface of the code plate 23, drops into the retaining recess 36 and fixedly retains the code plate 23.

Following this, when the hand lever 17 of the labeling machine is gripped, the ink supply device 59, which is attached to and moves with the yokes 19, applies ink to the indicia surfaces of both the code plate device 10 of the invention and the printing heads 12 and 12' of the printing device 13. After inking, the whole printing device 13, including the code plate device 10, is turned counterclockwise about the pivot 18 together with the yokes 19 so that each label L, which is transferred onto a platen 61 by the action of a transfer mechanism 62, may be imprinted.

Figure 5:
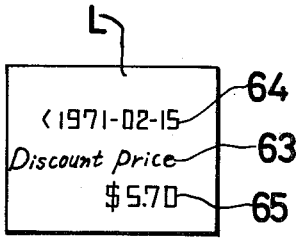
FIG. 5 shows a label that has been printed by a printing device equipped with the code plate device.

A typical imprint pattern is shown in FIG. 5. In this pattern, the word "Discount Price" is printed at 63 by the code plate 23 of the device 10 of the invention, while the specified figures 64 and 65 of "1971-02-15" and "$5.70" respectively indicating the production date and the price are printed as usual by the printing heads 12 and 12'. In FIG. 1, since the code plate device 10 is positioned at the rear of the printing device 13, as a result of the pitch determination of the transfer mechanism 62, the letters 63 are found at the center of the label L.

When it is desired to change the specified letters, marks and/or characters of the code plate 23, the code plate 23 is extracted from the casing 22, and it is replaced by a new code plate carrying different information. To remove the code plate 23, it is forced more deeply into the casing 22 while its retained condition is maintained, as shown in FIG. 3. The thrust surface 35 of the code plate 23 pushes the flange 37 of the sliding assembly 25, and the sliding assembly is forced to the right in FIG. 3. Then, the guided portion **26*a* of the engagement member 26, which has been retained in the retaining recess 38*b* of the heart-shaped cam groove 38 of the sliding assembly 25, is released from engagement with the retaining recess 38*b* and is guided in the converging or right-hand end portion of the cam groove 38** into the upwardly inclined groove.

Then, the sliding assembly 25 is moved to the left relative to its casing 42, cover 43 and the engagement member 26 are moved in FIG. 3, by the spring 41 until the condition of FIG. 2 is restored. More specifically, the one guided portion **26*a* of the member 26 drops into the stepped recess 38*a* at the converging end of the heart-shaped cam groove 38 after it is guided through the upwardly inclined portion of that cam groove 38. Also, the engagement between the retaining recess 36 of the code plate 23 and the retaining button 27 is released against the biasing force of the spring 48**.

To shift the printing position of the specified letters 63 on the label L, the position of the code plate device 10 of the invention on the frames 11 is changed, as described before. For this purpose, the paired pinch members 29 are pinched to remove the retaining rods 28 from the retaining bores 56 in the printing head frames 11. Then, a different position of the code plate device 10 is established by placing the retaining rods 28 in another pair of retaining bores 56' or 56''. In this instance, it is also necessary that the support shaft 57 of at least one of the printing heads 12 or 12' be shifted into other fitting bores 58'.

One of the frames 11 of the printing device 13 is formed with a notch **11*a* for easing insertion and removal of the code plate 23**.

The present invention permits the attachment and removal of the code plate in its casing simply and smoothly because provision is made for engagement and disengagement means for removably retaining the code plate in the case body. Furthermore, the code plate cannot be shifted out of position during the imprinting process because provision is made for retaining the code plate in position in its casing. Additionally, the code plate device is removably retained in position in the frame of the printing device because there is a pair of retaining rods and a pair of pinch members, between which a spring is interposed.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A labeling machine, including a code plate device, wherein said labeling machine comprises:

a machine frame; a printing device supported by said machine frame; a platen on which a label is to be imprinted; means for moving said printing device and said platen together to imprint a label on said platen;

said code plate device comprises:

a casing; casing retaining means for removably attaching said casing to said printing device and for positioning said code plate device such that said code plate device imprints a label on said platen as said printing device imprints that label;

a code plate having an imprint surface and supporting imprintable characters on said imprint surface; said code plate being adapted to be removably inserted into said casing from a position of initial insertion to a position of full insertion;

a sliding assembly in said casing which is positioned to be engaged by said code plate as said code plate is being initially inserted into said casing and which is engaged by and then slid through said casing by said code plate as said code plate is fully inserted in said casing; sliding assembly engagement means held in said casing in engagement with said sliding assembly; said sliding assembly having first and second terminal positions; said first terminal position being the position at which said code plate first engages said sliding assembly upon initial insertion of said code plate into said casing; said second terminal position being the position of full insertion of said code plate into said casing; said engagement means retaining said sliding assembly at either of said first and second terminal positions;

code plate retaining means in said casing for engaging and retaining said code plate in the fully inserted position thereof and at which said sliding assembly is at its said second terminal position.

2. The labeling machine of claim 1, wherein said engagement means includes an engagement member with two sliding assembly engaging guide portions; said sliding assembly including engageable portions engageable by said engagement member guide portions.

3. The labeling machine of claim 2, wherein one said engageable portion comprises a cam groove with two spaced apart recesses therein; one said cam groove recess being engageable by one said guide portion at said first sliding assembly terminal position, and the other said cam groove recess being engageable by the one said guide portion at said second sliding assembly terminal position, thereby to hold said sliding assembly at the respective one of its said terminal positions.

4. The labeling machine of claim 3, wherein said cam groove has a general heart shape such that it has side walls that converge as said one guide portion moves toward the said recess on said sliding assembly which said one guide portion engages when said sliding assembly is at said first terminal position at which said code plate is initially inserted;

said one guide portion being narrower than said cam groove, thereby to be guidable in motion by said converging cam groove side walls.

5. The labeling machine of claim 4, wherein said cam groove has a bottom wall engageable by said one guide portion as said sliding assembly moves between its said first and second terminal positions, and said bottom wall being inclined to raise said one guide portion as said one guide portion moves toward the said recess on said sliding assembly which said one guide portion engages when said sliding assembly is at said second terminal position at which said code plate is fully inserted.

6. The labeling machine of claim 1, wherein said code plate retaining means comprises a recess in said code plate; a retaining button in said casing adapted to be fitted into said code plate recess; biasing means for urging said retaining button into said code plate recess as said code plate is inserted into said casing up to the sliding assembly terminal position at which said code plate is fully inserted.

7. The labeling machine of claim 6, wherein said casing has a bore therein; said retaining button being placed in said casing bore; said biasing means being between said button and said casing.

8. The labeling machine of claim 1, further comprising biasing means attached to said sliding assembly for biasing said sliding assembly to said first terminal position thereof at which said code plate is out of said casing.

9. The labeling machine of claim 8, wherein said biasing means comprises a spring compressed between said sliding assembly and said engagement means.

10. The labeling machine of claim 9, further comprising a sliding assembly casing with respect to which said sliding assembly is slidable; said spring also being compressed between said sliding assembly and said sliding assembly casing.

11. The labeling machine of claim 9, wherein said code plate includes a thrust surface for abutting said sliding assembly as said code plate is inserted; said sliding assembly including a flange for being abutted by said thrust surface.

12. The labeling machine of claim 1, wherein said casing retaining means comprises retaining rod receiving recesses in said printing device; retaining rods in said casing, which are movable into and out of said receiving recesses therefor, and when said rods engage in said recesses, said rods holding said casing to said printing device;

biasing means for urging said retaining rods into said recesses therefor;

manually operable members attached to said retaining rods for being grasped and moved to remove said retaining rods from said recesses therefor in opposition to said biasing means.

* * * * *